United States Patent [19]

Minakuchi et al.

[11] Patent Number: 4,763,555

[45] Date of Patent: Aug. 16, 1988

[54] TREMOLO UNIT MECHANISM FOR ELECTRIC GUITAR

[75] Inventors: Kiyoshi Minakuchi; Junji Tomita, both of Hamamatsu, Japan

[73] Assignee: Nippon Gakki Seizo Kabushiki Kaisha, Hamamatsu, Japan

[21] Appl. No.: 42,271

[22] Filed: Apr. 24, 1987

[30] Foreign Application Priority Data

Apr. 25, 1986 [JP] Japan ..... 61-61726[U]
Jul. 9, 1986 [JP] Japan ..... 61-104285[U]

[51] Int. Cl.[4] ..... G10D 3/04
[52] U.S. Cl. ..... 84/313; 84/267
[58] Field of Search ..... 84/267, 298, 299, 312 R, 84/313

[56] References Cited

U.S. PATENT DOCUMENTS

| | | | |
|---|---|---|---|
| 2,972,923 | 2/1961 | Fender | 84/313 |
| 4,555,970 | 12/1985 | Rose | 84/313 |
| 4,608,906 | 9/1986 | Takabayashi | 84/313 |
| 4,638,711 | 1/1987 | Stroh | 84/313 |
| 4,674,389 | 6/1987 | Fender | 84/313 |

OTHER PUBLICATIONS

Publication showing an "Arm Lock" device available from Fernandez Corp.

Japanese Utility Model Laid-Open Specification No. Sho 56-75793.

*Primary Examiner*—Lawrence R. Franklin

*Attorney, Agent, or Firm*—Blakely, Sokoloff, Taylor & Zafman

[57] ABSTRACT

A tremolo unit mechanism for an electric guitar includes a bridge base vertically disposed to be pivotal about a support point on a body, balancing springs for causing a balance moment along a direction opposite to that of a moment due to a tension of strings to act on the bridge base, bridge main bodies, disposed on the bridge base, for holding one end of each of the strings, octave adjusting screws, threadably engaged with the bridge base, for moving the bridge base along a front-to-rear direction, a tremolo arm, mounted in the bridge base, for moving the bridge base vertically, and a control mechanism for controlling pivotal movement of the bridge base. The control mechanism includes an engaging member for engaging with the bridge base and a screw member for controlling pivotal movement/displacement of the engaging member.

7 Claims, 5 Drawing Sheets

TREMOLO UNIT MECHANISM FOR ELECTRIC GUITAR

BACKGROUND OF THE INVENTION

The present invention relates to a tremolo unit mechanism for an electric guitar, capable of rapidly and periodically varying a tension of strings to vary the pitch, thereby obtaining a special acoustic effect, a so-called tremolo effect.

A Fender type tremolo mechanism is known as a conventional tremolo unit, mechanism for an electric guitar. According to the Fender type tremolo mechanism, a bridge base vertically pivotally disposed on a body of an electric guitar is balanced with a moment due to a tension of strings by means of balancing springs, this balanced state is destroyed by a vertical movement of a tremolo arm, and the bridge base is pivoted to repeatedly vary the tension of the strings, thereby obtaining the tremolo effect.

In such a conventional tremolo unit mechanism, the pitch can be varied by pivoting the bridge base vertically from its rest position. However, a balanced state between the moment of the tension of the strings and that of the balancing springs tends to be destroyed when a tremolo arm is not operated, thereby posing a problem in terms of pitch stability during a non-tremolo performance.

In addition, when the string is strongly touched, the tremolo unit mechanism vibrates slightly, so that a musical tone fluctuation (pitch instability) undesirably remains.

In order to eliminate the above problems, the present inventor has recently proposed a tremolo unit mechanism in which a stopper screw is disposed in the bridge base to abut against the body at its lower end, thereby controlling pivotal movement of the bridge base toward the body to stabilize the bridge base. However, in this mechanism, since the stopper screw is disposed in the bridge base, size and weight of the bridge base are increased to increase moments of inertia thereof, so that a lingering tone undesirably remains when a tremolo arm is operated. Furthermore, in order to adjust a height of the bridge base over a wide range, the stopper screw needs to be vertically moved by about at least 10 mm, resulting in an upper end portion of the screw inconveniently projects upward from the bridge base.

In addition, in the tremolo unit mechanism of this type, the above-mentioned balanced state is easily destroyed to vary the pitch when a hand and the like touches the tremolo arm during a performance, so that the tremolo unit mechanism must be locked during a non-tremolo performance. For this reason, various lock mechanisms have been conventionally proposed to lock the tremolo unit mechanism. Examples are an "arm lock" device available from Fernandez Corp. and a lock mechanism of a tremolo unit mechanism disclosed in Japanese Utility Model Laid-Open No. 56-75793.

However, according to the former arm lock device, the bridge base can be locked only at a position where a cam engages with a groove and hence cannot be locked at given positions. On the other hand, according to the latter lock mechanism, the bridge base can be advantageously locked at a given position. However, when the bridge base is unlocked, a rotation cam abuts against lock pins against a performer's wish, resulting in a poor movement of a bridge assembly and hence in unstable tuning. In order to prevent this, accuracy of components and assembly must be improved, thereby causing high cost.

SUMMARY OF THE INVENTION

It is a principal object of the present invention to provide a tremolo unit mechanism which can realize stability of a bridge base during a non-tremolo performance to stabilize the pitch.

It is another object of the present invention to provide a tremolo unit mechanism to which strings can be easily replaced.

It is still another object of the present invention to provide a tremolo unit mechanism which can prevent an increase in a moment of inertia of a bridge base and hence can be easily incorporated in existing products.

It is still another object of the present invention to provide a tremolo unit mechanism which can lock a bridge base at a given position, and which can reliably fix and release a bridge base and hence is superior in operability.

In order to achieve the above objects, there is provided a tremolo unit mechanism for an electric guitar comprising a bridge base vertically disposed to be pivotal about a support point on a body, balancing springs for causing a balance moment along a direction opposite to that of a moment due to a tension of strings to act on the bridge base, bridge main bodies, disposed on the bridge base, for holding one end of each of the strings, octave adjusting screws, threadably engaged with the bridge base, for moving the bridge base along a front-to-rear direction, a tremolo arm, mounted in the bridge base, for moving the bridge base vertically, and a control mechanism for controlling pivotal movement of the bridge base, wherein the control mechanism includes an engaging member for engaging with the bridge base and a screw member for controlling pivotal movement/displacement of the engaging member.

According to the present invention, the bridge base is locked at its initial position by the stopper mechanism so that pivot toward the body, i.e., along a direction of increasing the pitch is controlled, thereby improving stability of the bridge base when the tremolo arm is not operated. In addition, since the stopper mechanism is disposed on the body, an increase in a moment of inertia of the bridge base.

DETAILED DESCRIPTION OF THE PREFERRED EMBODIMENTS

Figure 1:
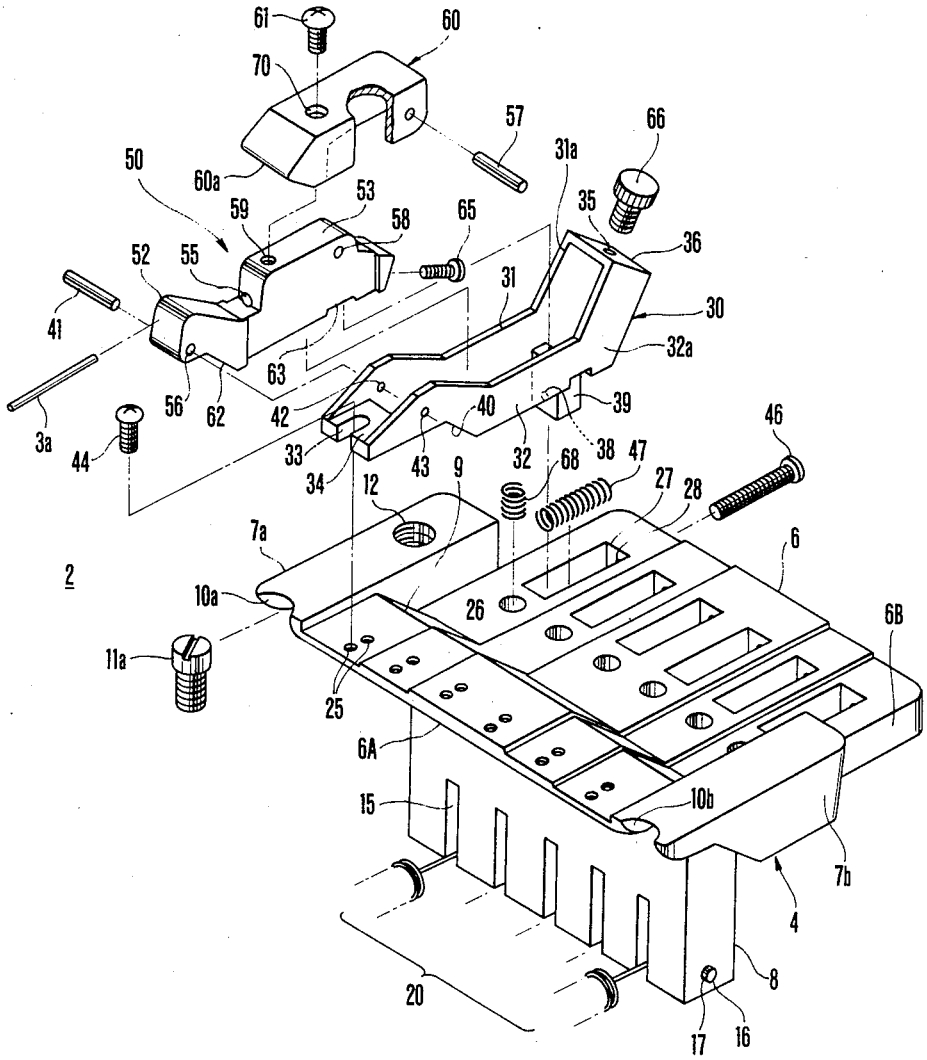
FIG. 1 is an exploded perspective view of main components showing an embodiment of a tremolo unit mechanism according to the present invention.
Figure 2:
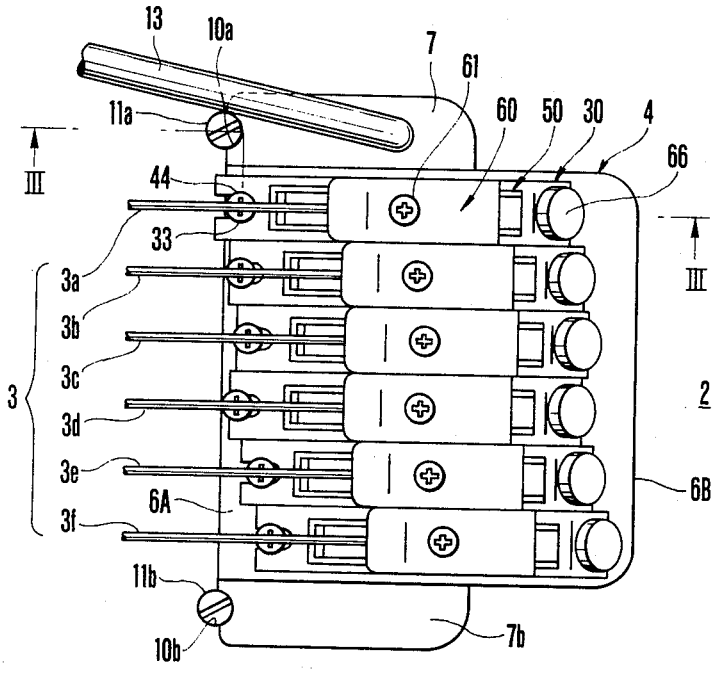
FIG. 2 is a plan view of the mechanism shown in FIG. 1.

The present invention will now be described in detail with reference to embodiments shown in the accompanying drawings.

FIGS. 1 to 4 show an embodiment of a tremolo unit mechanism according to the present invention, in which reference numeral 1 denotes a body of an electric guitar. A tremolo unit mechanism 2 is disposed on the upper surface of the body 1 and holds one end of each of a plurality of, e.g., 6, strings 3 (*3a* to *3f*), and a spring chamber 5 is formed on the surface of the body 1 and houses part of the tremolo unit mechanism 2.

The tremolo unit mechanism 2 includes a bridge base 4 which is vertically pivotally disposed with a part thereof inserted inside the spring chamber 5. The bridge base 4 includes a base 6 formed by bending so that a front end portion 6A is positioned higher than a rear end portion 6B and hence having a step 9 on its upper surface, extended portions *7a* and *7b* formed integrally with the base 6 respectively along both side edges at the first half of the base 6, and a spring locking portion 8 formed integrally with the lower surface front end of the rear end portion 6B and extending downward therefrom. The front end portion 6A is placed on the body 1, and the rear end portion 6B, rear ends of the extended portions *7a* and *7b*, and the spring locking portion 8 are inserted inside the spring chamber 5. Semicircular engaging recesses 10*a* and 10*b* are respectively formed at the front end surfaces of the pair of extended portions *7a* and *7b* and are urged by a tension of the strings 3 to be engaged with columns 11*a* and 11*b* extending from the body 1, thereby controlling and preventing forward movement and movement along the left-to-right direction of the bridge base 4. In addition, the columns 11*a* and 11*b* constitute vertical pivoting centers of the bridge base 4. The extended portion *7a* has a screw hole 12 with which the proximal end portion of a tremolo arm 13 (not shown in FIG. 1) is threadably engaged. The spring locking portion 8 is an elongated plate extending along a direction orthogonal to an extending direction of the strings 3 and has elongated grooves 15 formed in its lower end portion to correspond to balancing springs 20 and pin insertion holes 17 are opened at both side surfaces of the lower end portion. A spring locking pin 16 is inserted in the pin insertion holes 17 and is prevented by a set screw 18 from being removed. In this embodiment, 5 elongated grooves 15 are provided since 5 balancing springs 20 are used, one end of each balancing spring 20 is inserted in the corresponding elongated groove 15 to be hooked by the spring locking pin 16, and the other end thereof is hooked to a corresponding one of hooks 21. Therefore, a balance moment T2 along a direction opposite to that of a moment T1 of the tension of the strings 3 acts on the bridge base 4.

The base 6 of the bridge base 4 has 6 pairs of front and rear screw holes, i.e., 12 screw holes 25 formed in the front end portion 6A so as to correspond to the respective strings 3, and has 6 spring receiving recesses 26 and 6 elongated holes 27 extending along the front-to-rear direction, both of which are formed in the rear end portion 6B so as to correspond to the respective strings 3. In addition, 6 screw mounting holes 28 are formed in the rear end surface of the rear end portion 6B and communicate with the respective elongated holes 27. Note that the upper surface of the base 6 is formed to have a step along its widthwise direction so that its center portion corresponding to the third and fourth strings *3c* and *3d* is the highest portion, middle portions respectively corresponding to the second and fifth strings *3b* and *3e* are lower than the central portion, and both side portions respectively corresponding to the first and sixth strings *3a* and *3f* are the lowest portions.

Bridge mounts 30 and bridge main bodies 50 are disposed on the bridge base 4 having the above arrangement to correspond to the respective strings 3. Each bridge mount 30 is formed to have a frame-shape elongated along the front-to-rear direction and hence is constituted by: a pair of left and right side plates 31 and 32 respectively having bent portions 31*a* and 32*a* which oppose each other and rear ends of which extend obliquely upward; a first connecting plate 34, having a U-shaped groove 33, for connecting the front ends of the pairs of side plates 31 and 32; a second connecting plate 36, having a screw hole 35, for connecting the upper ends of the pair of bent portions 31*a* and 32*a*; a third connecting plate 39, having a screw hole 38, for connecting the rear ends of the side plates 31 and 32, and extending below the side plates 31 and 32. Steps 40 corresponding to the step 9 formed on the upper surface of the base 6 of the bridge base 4 are formed on the lower surfaces of the pair of side plates 31 and 32. In addition, small holes 42 and 43 are respectively formed in the front ends of the pair of side plates 31 and 32, and a shaft 41 is inserted in the small holes 42 and 43 to pivotally support the bridge main body 50. A set screw 44 is inserted in the U-shaped groove 33 of the first connecting plate 34 and is threadably engaged with either of the pair of screw holes 25 formed in the front end portion 6A of the base 6 of the bridge base 4, thereby fixing the bridge mount 30 on the base 6.

The third connecting plate 39 is inserted from the upper direction in the elongated hole 27 formed in the base 6 of the bridge base 4 and is connected to the base 6 by an octave adjusting screw 46 threadably engaged with the screw hole 38 from the screw mounting hole 28. When the set screw 44 is untightened beforehand and the octave adjusting screw 46 is rotated, the bridge mount 30 is moved along the front-to-rear direction, i.e., the extending direction of the strings 3. Note that reference numeral 47 denotes a compression spring for biasing the third connecting plate 39 forward, and the compression spring 47 is mounted to the octave adjusting screw 46 and is located in the elongated hole 27.

The bridge main body 50 is a deformed rod-like member elongated along the front-to-rear direction and disposed in the bridge mount 30. The front end of the bridge main body 50 is vertically pivotally supported by the shaft 41. The front end upper surface of the bridge main body 50 projects to be substantially V-shaped so as to constitute a string support portion 52, and a substantially parallelpiped projection 53, on which a rocker arm 60 (to be described later) is fitted from the upper direction, is formed integrally with the string support portion 52. The bridge main body 50 has an inclined string insertion hole 55, one end of which is open at the front end lower portion of the projection 53, and the other end of which is open at the rear end surface of the bridge main body 50, a saft hole 56 in which the shaft 41 is inserted, a shaft hole 58 in which a shaft 57 is inserted to vertically pivotally support the rocker arm 60, and a screw hole 59 with which a lock screw 61 is threadably engaged to fix the rocker arm 60 on the projection 53. Similar to the bridge mount 30, a step 62 corresponding to the step 9 formed on the base 6 of the bridge base 4, and a recess 63 in which the upper portion of the third connecting plate 39 of the bride mount 30 is fitted, are formed on the lower surface of the bridge main body 50. Each string 3 is extended with respect to the bridge main body 50 such that the string 3 (3*a*) is inserted in the string insertion hole 55 from the rear end of the bridge main body 50 over the string support portion 52 and its distal end is wound around a peg (not shown) of a neck main body. The string 3 is wound up by the peg to obtain a predetermined tension, thereby tuning the string 3 at a predetermined pitch. In this case, the string 3 is prevented by a ball end provided at its proximal end from being removed from the string insertion hole 55. In addition, when the strings 3 are extended, the bridge main body 50 is subjected to rotational moment along a counterclockwise direction in FIG. 1 about the shaft 41 due to a tension of the strings 3. In order to prevent pivotal movement of the bridge main body 50, a tuning screw 66 is threadably engaged with the screw hole 35 formed in the second connecting plate 36 of the bridge mount 30, and the screw 66 urges the rear end of the bridge main body 50 against the base 6 of the bridge base 4. The bridge main body 50 tends to be pivoted in a counterclockwise direction in FIG. 1 by a spring 68 disposed in the spring receiving recess 26 formed in the base 6. When the tuning screw 66 is untightened to release or remove the string 3, the spring 68 effectively prevents cluttering of the bridge main body 50.

The rocker arm 60 presses a portion of the string 3 extended over the string support portion 52 from the string insertion hole 55 against the upper surface of the bridge main body 50 and locks it, thereby preventing looseness of the string 3. As described above, the rear end of the rocker arm 60 is vertically pivotally supported by the shaft 57, a string press portion 60*a* is formed integrally with the front end thereof, and a screw mounting hole 70 in which the lock screw 61 is inserted is formed in the upper surface thereof.

A stopper mechanism 75 which characterizes the present invention is disposed on a rear wall inner surface of the spring chamber 5. The stopper mechanism 75 locks the tremolo unit mechanism 2 at a non-operation position, thereby preventing pivotal movement of the tremolo unit mechanism 2 along the direction of the body 1, i.e., the direction of increasing the pitch (clockwise direction in FIG. 3). The stopper mechanism 75 is constituted by a substantially U-shaped screw mounting member 77 fixed on the rear wall of the spring chamber 5 by a pair of right and left set screws 76, a height adjusting screw 78 rotatably disposed in the screw mounting member 77, an elevating member 79 threadably engaged with the screw 78 and moved up and down by rotation of the screw 78, a coil spring 80 mounted on the height adjusting screw 78 to bias the elevating member downward, and the like. The screw mounting member 77 is constituted by a vertical plate 77A, an upper plate 77B, and a lower plate 77C formed by substantially horizontally bending the upper and lower end portions of the vertical plate 77A and opposing each other. A longitudinally elongated guide hole 81 of the elevating member 79 is formed in the center of the vertical plate 77A. Screw mounting holes (not shown) in which the height adjusting screw 78 is inserted are respectively formed in the upper and lower plates 77B and 77C, and a pair of right and left screw mounting holes 82*a* and 82*b* are formed in correspondence with the set screws 76.

The elevating member 79 is formed to be substantially L-shaped and inserted through the guide hole 81, a vertical portion extending upwardly therefrom constitutes an abutment portion 84 which abuts against the rear end lower surface of the bridge base 4, and a damper 85 such as a felt is adhered on the upper surface of the abutment portion 84.

Figure 3:
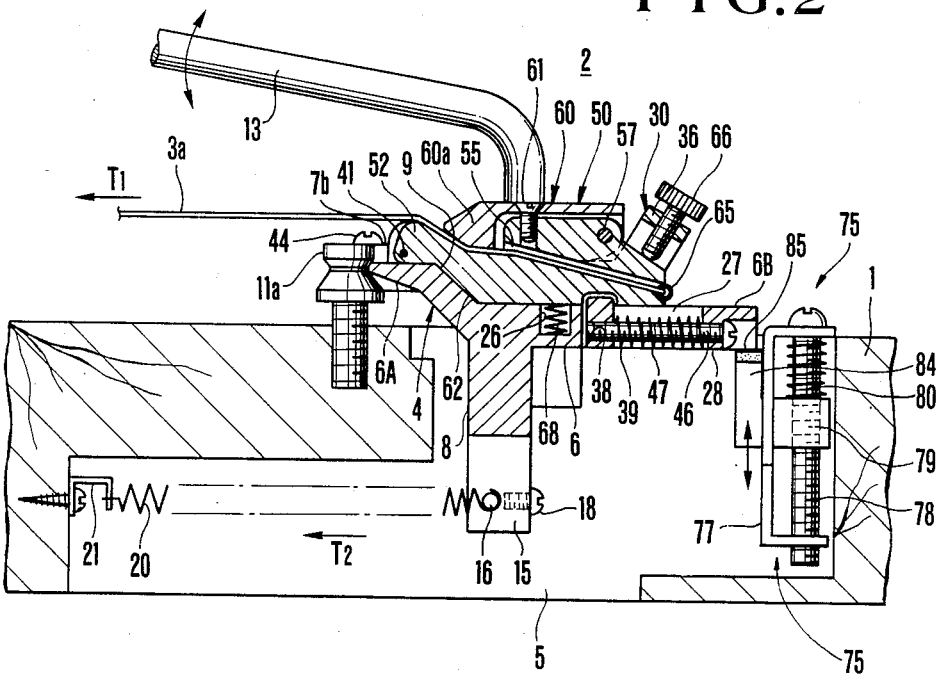
FIG. 3 is a sectional view taken along the line III—III of FIG. 2.
Figure 4:
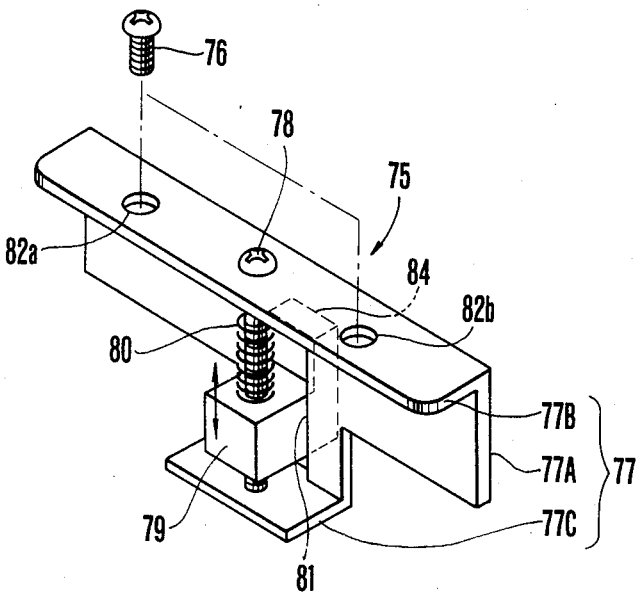
FIG. 4 is a perspective view of a stopper mechanism.
Figure 7:
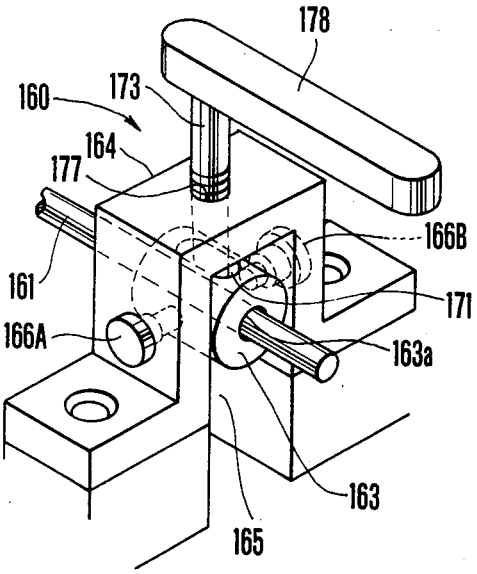
FIG. 7 is a perspective view of a lock mechanism.

In the tremolo unit mechanism 2 having the above arrangement, a moment T1 along the counterclockwise direction in FIG. 3, which is caused by the tension of a total sum of the strings 3, is balanced with a moment T2 along the clockwise direction due to a total sum of biasing forces of the balancing springs 20 at a certain point, thereby setting the bridge base 4 substantially horizontally. When the pitch need not be increased by rotating the tremolo unit, the moment T2 is preferably set larger than the moment T1. When the height adjusting screw 78 is tightened to be rotated at the current position, the elevating member 79 is moved upward to push the bridge base 4 upward by the abutment portion 84, so that pivotal movement of the bridge base 4 along the clockwise direction is controlled. Since the bridge base 4 is prevented by the elevating member 79 from pivoting along the direction of increasing the pitch, the tremolo arm 13 is well stabilized when it is not operated, thereby maintaining stability of the pitch. In order to pivot the tremolo unit along the clockwise direction to increase the pitch, the elevating member 79 is moved downward. An increasing amount of pitch is determined by a decreasing amount of the elevating member 79. On the other hand, the tremolo arm 13 is moved downward, the bridge base 4 is pivoted along the counterclockwise direction in FIG. 3 about the pair of columns 11*a* and 11*b* to decrease the tension of the strings 3, thereby obtaining the tremolo effect along the direction of decreasing the pitch. In addition, since the stopper mechanism 75 is disposed in the spring chamber 5 to push the bridge base 4 upward from the lower direction, any additional component need not be provided to the bridge base 4, so that the moment of inertia of the tremolo unit mechanism 2 is not increased and a lingering tone during performance is reduced. In addition, the stopper mechanism can be easily incorporated in existing products.

Note that in the above embodiment, the tuning screw 66 is disposed in the bridge mount 30, but it may be disposed in the bridge base 4. In this case, the bent portions 31*a* and 32*a* and the second connecting plate 36 of the bridge mount 30 can be omitted, and a substantially U-shaped screw mounting portion corresponding to the above components may be provided to the bridge base 4.

As has been described above, in the tremolo unit mechanism for the electric guitar according to the present invention, the rear end of the bridge base is supported from the lower direction by the stopper mechanism disposed on the body to control pivotal movement of the bridge base toward the body. Therefore, the bridge base can be stably locked at its initial position, and hence pitch instability caused by rocking motion of the tremolo unit mechanism when the tremolo arm is not operated can be eliminated, thereby improving pitch stability. In addition, if the rear end of the bridge base is lifted when the strings are to be replaced, the strings can be very easily replaced. Furthermore, since no additional component need be incorporated in the tremolo unit mechanism itself, its moment of inertia is not increased, so that the tremolo unit mechanism can be easily incorporated in existing products.

FIGS. 5 to 8 show another embodiment of the tremolo unit mechanism according to the present invention, in which reference numeral 130 denotes a body of an electric guitar, and a tremolo unit 132 is disposed on the upper surface (surface 130*a*) of the body 130 to hold one end of each of a plurality of, e.g., 6 strings 131 (131*a* to 131*f*).

Figure 5:
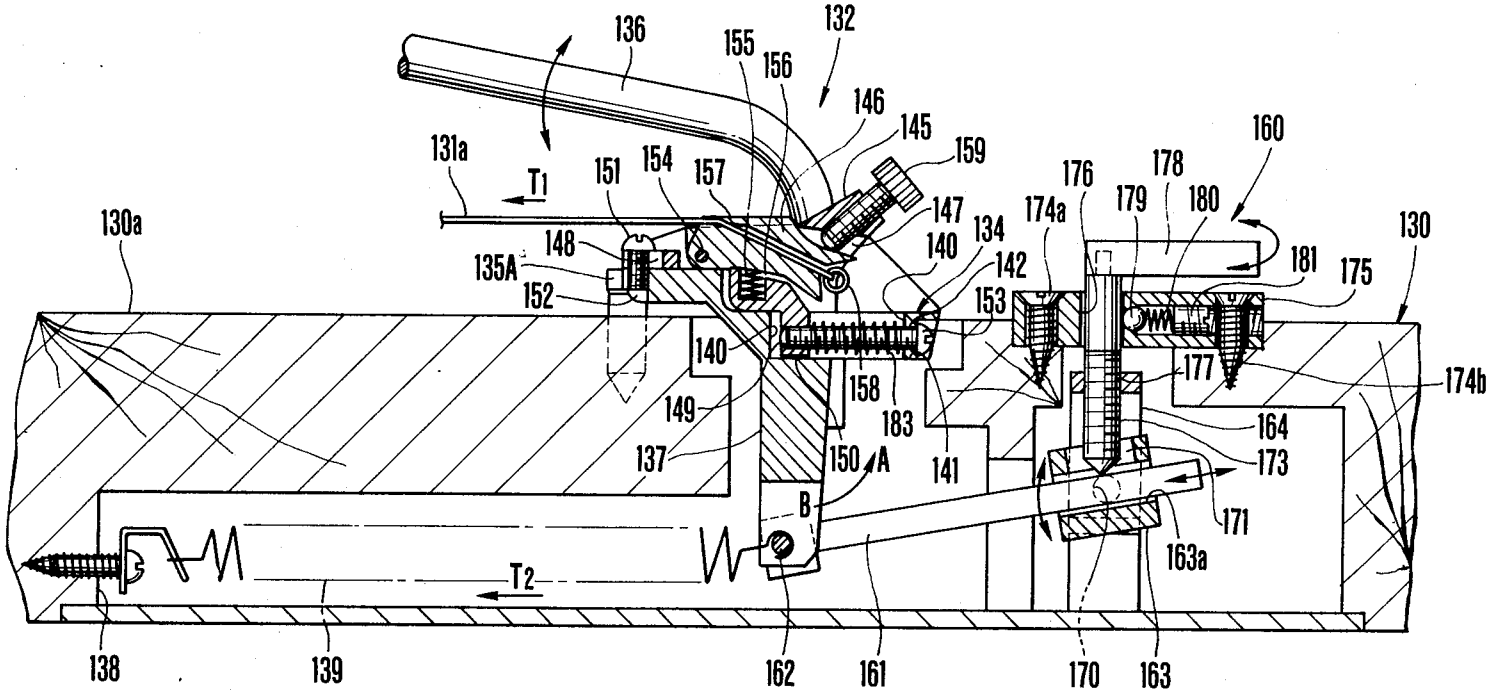
FIG. 5 is a sectional view taken along the line I—I of FIG. 6 showing another embodiment of the tremolo unit mechanism according to the present invention.
Figure 6:
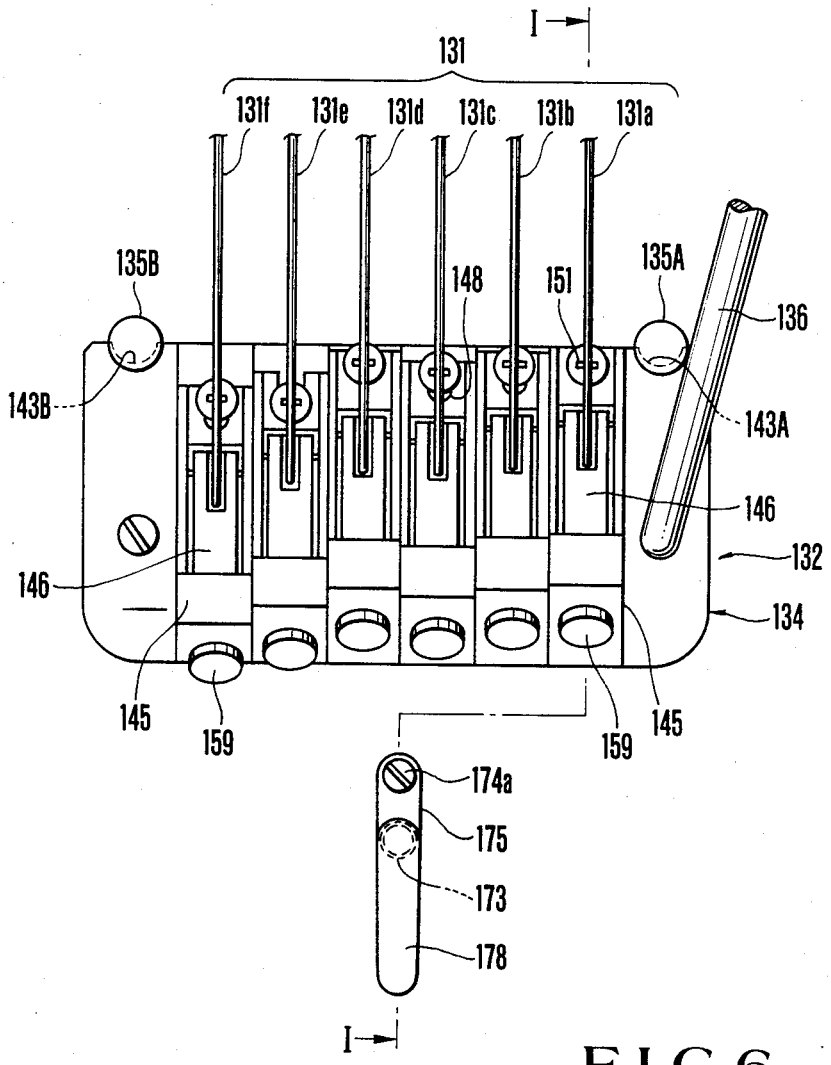
FIG. 6 is a plan view of the mechanism shown in FIG. 5.

The tremolo unit mechanism 132 includes a bridge base 134 disposed on the body 130 to be vertically (along a direction indicated by arrows A and B) pivoted about its front end (left end in FIG. 5). The bridge base 134 abuts at both its front end face sides against a pair of right and left columns 135A and 135B extending from the body 130 to be prevented from moving toward a neck main body, and is pivoted vertically about the columns 135A and 135B. A plate-like spring locking portion 137 is formed integrally with the bridge base 134 and extends vertically from the substantially central portion of its lower surface. The spring locking portion 137 is inserted in a spring chamber 138 provided on the rear surface of the body 130, and one end of each of a plurality of (e.g., 5) balancing springs 139 is locked at the lower end of the spring locking portion 137. By these springs 139, the bridge base 134 is subjected to a rotational moment T2 substantially the same as but along a direction opposite to that of a rotational moment T1 due to a total sum of tensions of the strings 131. Six elongated holes 140 extending along the front-to-rear direction are formed on the upper surface rear side of the bridge base 134 in correspondence with the strings 131*a* to 131*f*, and 6 screw mounting holes 142 are formed on the rear end face 141 to respectively communicate with the elongated holes 140. Note that abutment portions 143A and 143B provided at the front end face of the bridge base 134 to abut against the columns 135A and 135B are respectively semicircular and edge-shaped because the lower surface of the bridge base 134 is obliquely cut and hence the abutment portions 143A and 143B point-contact the columns 135A and 135B.

Six mountings 145 are disposed in correspondence with the strings 131*a* to 131*f* on the bridge base 134 having the above arrangement, and bridge main bodies 146 are vertically pivotally disposed in the mountings 145 to lock one end of each of the strings 131. Each mounting 145 has an insertion hole 147 formed in its front and rear surfaces and in which each bridge main body 146 is inserted, and a connecting portion 150 is formed integrally with the mounting 145 to extend downward therefrom. The connecting portion 150 has a U-shaped groove 148 elongated along the front-to-rear direction at its front end and a screw hole 149 at its rear end lower surface, and is inserted in the elongated hole 140 of the bridge base 134. A set screw 151 is inserted in the U-shaped groove 148 and threadably engaged with a screw hole 152 formed in the front end upper surface of the bridge base 134, thereby fixing the mounting on the bridge base 134. The connecting portion 150 is connected to the bridge base 134 through an octave adjusting screw 153 which is inserted in the screw mounting hole 142 and threadably engaged with the screw hole 149. When the set screw 151 is untightened beforehand and the octave adjusting screw 153 is rotated, the mounting 145 is moved along the front-to-rear direction, i.e., an extending direction of the strings 131 within a range of the U-shaped groove 148, and each string 131 is tuned at a predetermined pitch by a peg.

The front end of the bridge main body 146 is supported by a shaft 154 so that the rear end thereof is moved vertically in the insertion hole 147 of the mounting 145 and the bridge main body 146 normally tends to be pivoted. Both ends of the shaft 154 are supported by both side walls of the mounting 145. The spring 155 is housed in a spring receiving recess 156 formed in the upper surface of the mounting 145. The bridge main body 146 has a string insertion hole 157 in which the string 131 is inserted, and a ball end 158 is locked at the rear end opening of the insertion hole 157 to prevent removal of the string 131. A set screw 159 is threadably engaged with the rear end upper surface of the mounting 145 to fix the bridge main body 146 to the mounting 145, and the distal end of the set screw 159 projects in the insertion hole 147 to urge the rear end upper surface of the bridge main body 146.

Figure 8:
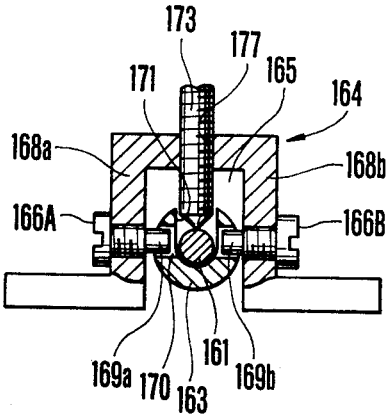
FIG. 8 is a partially cutaway rear view of the lock mechanism shown in FIG. 7.

The tremolo unit mechanism 132 further has a lock mechanism 160 for locking the bridge base 134 at a given pivotal position. The lock mechanism 160 includes a shaft 161 which extends backward, and one end of the mechanism 160 is pivotally connected to a position different from the pivoting center of the bridge base 134, e.g., the lower end of the spring locking portion 137. The shaft 161 is easily connected by inserting a pin 162 to which one end of the balancing spring 139 is hooked in an insertion hole (not shown) provided at one end of the shaft 161. The other end of the shaft 161 is slidably supported by the shaft support member 163. The shaft support member 163 is formed to be cylindrical-shaped so as to be disposed in a space 165 of a metal member 164 formed to be substantially crank-shaped and having a central hole 163*a* through which the other end of the shaft 161 is inserted, and is vertically pivotally (rockably) supported by a pair of right and left pins 166A and 166B. As shown in FIG. 8, the pair of pins 166A and 166B are respectively threadably engaged with screw holes formed in side walls 168*a* and 168*b* of the metal member 164, and round rod-like distal end portions 169*a* and 169*b* of the shaft pins 166A and 166B are inserted in a pin insertion hole 170 formed at the center of the shaft support member 163 to be orthogonal to the axis. In addition, an elongated hole 171 extending along the axial direction is formed in the upper surface central portion of the shaft support member 163 to communicate with the central hole 163, and the lower end of a screw member 173 as a fixing means for fixing the shaft 161 to the shaft support member 163 is inserted in the elongated hole 171 to abut against the upper surface of the other end of the shaft 161. The screw member 173 is threadably engaged with a screw hole 177 formed in the upper surface central portion of the metal member 164 via a through hole 176 of a base block 175 fixed on the upper surface 130*a* of the body 130 by a pair of front and rear set screws 174*a* and 174*b*, and a lever 178 is mounted on the upper end of the screw member 173. A steel ball 179, a spring 180 and a machine screw 181 are disposed in the base block 175 to serve as an adjusting mechanism for adjusting an operational force of the lock mechanism 160. The steel ball 179 is urged against the outer surface of the screw member 173 by a biasing force of the spring 180, and the biasing force of the spring 180 is adjusted by the machine screw 181.

Note that in FIG. 5, reference numeral 183 denotes a spring for forwardly biasing the mounting 145.

In the tremolo unit mechanism 132 having the above arrangement, the screw member 173 is normally moved upward during performance so that the other end of the shaft 161 is free from the shaft support member 163. In this state, when the tremolo arm 136 is moved vertically during the performance, a balanced state between the moment T1 by the total sum of tensional forces of the strings 131 and the moment T2 by the biasing force of the balancing springs 139 is destroyed to vary the tensional forces of the strings 131*a* to 131*f*, thereby obtaining a tremolo effect. At this time, when the bridge base 134 is moved vertically about the columns 135A and 135B, the shaft 161 is pivoted vertically about its other end and is moved forward and backward. In addition, the shaft support member 163 is pivoted vertically about the pair of shaft pins 166A and 166B along with movement of the shaft 161. Therefore, the shaft 161 and the shaft support member 163 do not adversely affect the movement of the bridge base 134, so that a good tremolo effect can be obtained.

In order to fix the tremolo unit mechanism 132 at a given position, the tremolo arm 136 is moved upward or downward, and at the same time, the lever 178 is pivoted to urge the screw member 173 against the shaft 161, so that the shaft 161 is fixed in the central hole 163*a* of the shaft support member 163. As a result, the shaft 161 is prevented from moving forward or backward, thereby locking the tremolo unit mechanism at the current position. Therefore, even if a hand touches the tremolo arm during a performance, the pitch is not varied at all. In addition, since the shaft 161 is urged by the screw member 173, if the electric guitar is violently moved, the tremolo unit mechanism is not moved, thereby obtaining reliable stability. Furthermore, the tremolo unit mechanism can be easily locked and unlocked, and high dimensional accuracy is not required during manufacture of the components, resulting in low cost.

Note that in the above embodiment, a description has been made with reference to the tremolo unit mechanism in which the bridge main bodies 146 are incorporated in the mountings 145. However, the present invention is not limited to this embodiment, and the tremolo unit mechanism itself can be variously modified. For example, the mountings 145 need not be provided, and the bridge main bodies 146 may be directly disposed on the bridge base to be moved forward and backward by the octave adjusting screws.

As has been described above, the tremolo unit mechanism for an electric guitar according to the present invention includes a lock mechanism consisting of a shaft connected at its one end to a bridge base, a pivotal shaft support member for slidably supporting the other end of the shaft, and a fixing means for fixing the shaft to the shaft support member. Therefore, the tremolo unit mechanism can be reliably fixed at a given pivotal position and can be reliably released therefrom. In addition, the tremolo unit mechanism has a simple structure, and its locking/unlocking operation can be easily performed to lead to superior operability, and hence can be effectively used in practice.

What is claimed is:

1. A tremolo unit mechanism for an electric guitar, comprising:

a bridge base vertically disposed pivotally about a support point on a body;

balancing springs causing a balance moment along a direction opposite to a moment due to a tension of strings to act on said bridge base;

bridge main bodies, disposed on said bridge base, for holding one end of each of the strings;

octave adjusting screws, threadably engaged with said bridge base, for moving said bridge main bodies along a front-to-rear direction;

a tremolo arm, mounted on said bridge base, for moving said bridge base vertically; and a stopper mechanism for preventing pivotal movement of said bridge base toward said body, wherein said stopper mechanism is constituted by a height adjusting screw rotatably disposed with respect to said body and a control member threadably engaged with said height adjusting screw to move up and down and having an abutment portion to abut against a lower surface of said bridge base.

2. A mechanism according to claim 1, wherein said height adjusting screw is rotatably disposed with respect to said body, said control member is moved up and down along with rotation of said height adjusting screw, and part of said control member is engaged with said bridge base to control its pivotal movement.

3. A mechanism according to claim 2, wherein said part of said control member is engaged with said bridge base through a damper.

4. A tremolo unit mechanism for an electric guitar comprising:

a bridge base vertically disposed pivotally about a support point of a body;

bridge main bodies, disposed on said bridge base, for holding one end of each of strings;

balancing springs, each having one end connected to a corresponding one of said bridge main bodies and the other end connected to said bridge base, for causing a balance moment along a direction opposite to that of a moment due to a tension of the strings to act on said bridge base; and a lock mechanism for locking said bridge base at a given pivotal position, wherein said lock mechanism is constituted by a control member pivotally connected at one end to a position spaced apart from a pivotal center of said bridge base, a control member support member, pivotally supported, for slidably supporting the other end of said control member, and fixing means for fixing the other end of said control member to said control member support member.

5. A mechanism according to claim 4, wherein said control member is a shaft pivotally connected at one end to said bridge base, said lock mechanism has a shaft support member for slidably and pivotally supporting said shaft, and said fixing means consists of a screw member and controls movement of said shaft support member.

6. A mechanism according to claim 5, wherein said screw member is rotatably disposed with respect to said body, and a lever is fixed at the upper end of said screw member.

7. A tremolo unit mechanism for an electric guitar, comprising:

a bridge base vertically disposed to be pivotal about a support point on a body;

balancing springs for causing a balance moment along a direction opposite to that of a moment due to a tension of strings to act on said bridge base;

bridge main bodies, disposed on said bridge base, for holding one end of each of the strings;

octave adjusting screws, threadably engaged with said bridge base, for moving said bridge base along a front-to-rear direction;

a tremolo arm, mounted in said bridge base, for moving said bridge base vertically; and a control mechanism for controlling pivotal movement of said bridge base, wherein said control mechanism includes an engaging member for engaging with said bridge base and a screw member for controlling pivotal movement or pivotal displacement of said engaging member.

* * * * *